US005308522A

United States Patent [19]

Francisco et al.

[11] Patent Number: 5,308,522

[45] Date of Patent: May 3, 1994

[54] STRESS ACTIVATED HIGH LOAD ADDITIVES FOR LUBRICANT COMPOSITIONS

[75] Inventors: Manuel A. Francisco, Washington; Thomas L. Ashcraft, Scotch Plains, both of N.J.; Alan R. Katritzky, Gainesville, Fla.

[73] Assignee: Exxon Research and Engineering Company, Florham Park, N.J.

[21] Appl. No.: 97,476

[22] Filed: Jul. 27, 1993

[51] Int. Cl.[5] ..... C10M 105/74

[52] U.S. Cl. ..... 252/49.9; 252/32.5

[58] Field of Search ..... 252/49.9, 32.5

[56] References Cited

U.S. PATENT DOCUMENTS 3,919,096 11/1975 Olszewski ..... 252/46.7

*Primary Examiner*—Jacqueline V. Howard
*Assistant Examiner*—Cephia D. Toomer
*Attorney, Agent, or Firm*—James H. Takemoto

[57] ABSTRACT

A lubricant composition which comprises a major amount of a lubricating oil base stock and a minor amount of a benzotriazole of the formula:

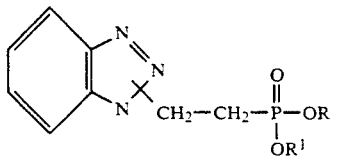

(I)

where R and $R^1$ are hydrocarbyl groups having from 1 to 30 carbon atoms. The load-carrying properties of the benzotriazoles of the formula (I) are activated by subjecting the lubricant composition to load-carrying conditions.

8 Claims, No Drawings

STRESS ACTIVATED HIGH LOAD ADDITIVES FOR LUBRICANT COMPOSITIONS

BACKGROUND OF THE INVENTION

1. Field of the Invention

This invention relates to stress activated high load additives and to lubricant compositions containing such additives. The load additives are activated under high load conditions such as engine operating conditions.

2. Description of the Related Art

Lubricants typically require the presence of additives to protect moving parts from the adverse effects of friction. Load-carrying additives are commonly added to oils and greases to improve the ability of the oil or grease under friction producing stress to protect from wear and damage to moving metal parts. For example, U.S. Pat. Nos. 4,144,180; 4,456,539 and 4,626,368 disclose triazole derivatives having a phosphorous moiety directly bound to the triazole ring system. These additives show load-carrying, antioxidant or antiwear properties and are active without regard to operating conditions.

Some of the problems presented by many typical additives relate to seal degradation and lubricant incompatibility. It would be desirable to have a high load lubricant additive which becomes activated only under the stress of operating conditions thereby avoiding prolonged contact of active species with seals and other sensitive components.

SUMMARY OF THE INVENTION

This invention relates to a lubricant composition which comprises (a) a major amount of a lubricating oil basestock and (b) a minor amount of a benzotriazole having the formula (I)

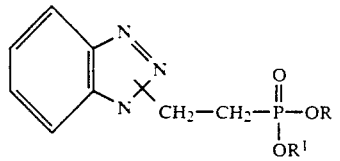

where R and $R^1$ are independently hydrocarbyl groups having from 1 to 30 carbon atoms. Another embodiment of the invention concerns a method for improving the load-carrying capacity of a lubricant composition under load conditions which comprises adding to a major amount of a lubricant basestock a minor amount of a benzotriazole of the formula (I) above and subjecting the lubricant composition to load conditions wherein the benzotriazole becomes load-carrying activated under load conditions.

DETAILED DESCRIPTION OF THE INVENTION

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(l-hexenes), poly(l-octenes), poly(1-decenes), etc., and mixtures thereof); alkylbenzenes (e.q. dodecylbenzenes, tetradecylbenzenes, dinonylbenzenes, di(2-ethylhexyl)benzene, etc.); polyphenyls (e.q. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl etherb Of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic j.-It esters thereof (e.q., the acetic acid esters, mixed $C_3$-$C_8$ fatty acid esters, and $C_{13}$ oxo acid diester of tetraethylene glycol).

Another suitable class of synthetic lubricating oils comprises the esters of dicarboxylic acids (e.q., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.q., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, pentaerythritol monoethylether, and the like.

Silicon-based oils (such as the polyakyl-, polyaryl-, polyalkoxy-, or polyaryloxy-siloxane oils and silicone oils) comprise another useful class of synthetic lubricating oils. These oils include tetraethyl silicone, tetraisopropyl silicone, tetra-(2-ethylhexyl) silicone, tetra-(4-methyl-2-ethylhexyl) silicone, tetra(p-tert-butylphenyl) silicone, hexa-(4-methyl-2-pentoxy)-disiloxane, poly(-methyl)-siloxanes and poly(methylphenyl) siloxanes, and the like. Other synthetic lubricating oils include liquid esters of phosphoruscontaining acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.q., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

In the benzotriazoles of this invention having the formula (I), R and $R^1$ are preferably independently hydrocarbyl groups having from 1 to 30 carbon atoms. The hydrocarbyl groups include aliphatic (alkyl or alkenyl) and alicyclic groups which may be substituted by hydroxy, amino and the like. Especially preferred are $R=R^1$ and both are $C_1$ to $C_8$ alkyl. Examples of preferred R and $R^1$ include alkyl include methyl, ethyl, butyl, octyl and decyl.

In the lubricant compositions according to this invention, the benzotriazole component exhibits low load-carrying capacity in the absence of thermal/oxidative stress such as would occur during storage. This is desirable because the present benzotriazoles do not significantly degrade elastomer seals or cause lubricant in compatibility problems. Under the thermal/oxidative stress encountered during mechanical operation where friction stress is created, it is believed that the benzotriazoles of the formula (I) fragment into load-carrying fragments. The precise chemical identity of such fragments is not known. However, the lubricant composition of the invention do exhibit excellent load-carrying capacity under the thermal/oxidative stress conditions encountered under load conditions.

Benzotriazoles of the formula (I) are a mixture of isomers and are prepared by reacting a dialkyl phospate with 1,2-dibromoethane. The intermediate is then reacted with benzotriazoles to produce the benzotriazole of the formula (I). This process is illustrated as follows:

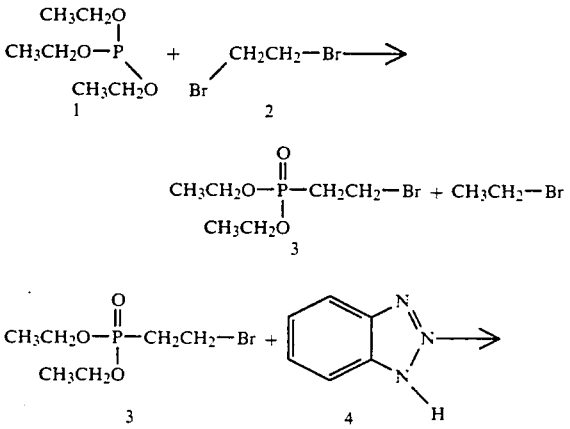

-continued

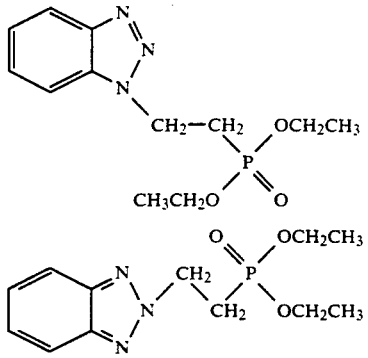

I

The amount of benzotriazole of the formula (I) used in the lubricant composition of this invention is that amount effective to impart load carrying, i.e., extreme pressure properties to the lubricant. Typically, the concentration of benzotriazole of the formula (I) will range from about 0.01 to about 5 wt %, preferably from about 0.05 to about 1.0 wt %, especially about 0.05 to about 0.1 wt % based on lubricant.

The benzotriazoles of this invention can be added directly to the lubricating oil. Often, however, they can be made in the form of an additive concentrate to facilitate their handling and introduction into the oil. Typically, the concentrate will contain a suitable organic diluent and from about 5 to about 95 wt %, preferably from about 25 to about 50 wt %, of the additive. Suitable organic diluents include mineral oil, naphtha, benzene, toluene, xylene, and the like. The diluent should be compatible (e.g. soluble) with the oil and, preferably, substantially inert.

If desired, other additives known in the art may be added to the lubricating oil basestock. Such additives include dispersants, antiwear agents, antioxidants, corrosion inhibitors, detergents, pour point depressants, other extreme pressure additives, viscosity index improvers, friction modifiers, and the like. These additives are typically disclosed, for example in "Lubricant Additives" by C. V. Smalhear and R. Kennedy Smith, 1967, pp. 1-11 and in U.S. Pat. No. 4,105,571, the disclosures of which are incorporated herein by reference.

A lubricating oil containing the benzotriazoles described above can be used in essentially any application where wear protection, antioxidant protection and/or friction reduction is required. Thus, as used herein, "lubricating oil" (or "lubricating oil composition") is meant to include automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples, which include a preferred embodiment of this invention.

EXAMPLE 1

This example illustrates the preparation of a benzotriazole according to the invention.

Triethyl phosphite (1.66 g, 10 nunol) and 1,2-dibromoethane (7.5 g, 40 nunol) were heated under reflux for 3 hours and the excess dibromoethane distilled off under reduced pressure (6–7 mm Hg). The residue was purified by distillation to give a pure product which is diethyl 2-bromoethylphosphonate.

A solution of benzotriazole (1.19 g, 10 nunol) and NAOH (0.4 g, 10 mmol) in water (15 ml) was added to diethyl 2-bromoethylphosphonate (2.45 g, 10 mmol) and stirred at 90° C. for 6 hours. The solution was then washed with diethyl ether (2 X 80 mi), the organic fraction washed with water (3×30 mi) and dried ($MgSO_4$). The solvent was removed under reduced pressure and the residue purified by column chromatography to yield a mixture of the two isomers of diethyl 2-(benzotriazolyl)ethylphosphonate as a yellow oil which was not separated (1.5 g, 53%). Anal. found: M+, m/z, 283.1091: C12HI8N303P requires M+, m/z 283.1085. Results by proton-1 NMR, delta 8.1–7.3 (m, 4H), 5.05–4.85 (m, 2H), 4.2–4.0 (m, 4H), 2.75–2.50 (m, 2H), and 1.35–1.20 (m, 6H), By Carbon-13 NMR one isomer was delta 145.3, 132.3, 126.9, 123.5, 119.3, 108.9, (61.59, 61.51, J(P-C) =6 Hz), 41.7 (27.01, 25.14, J(P-C)=140.24 Hz), and (15.79, 15.71, J(P-C) =6 Hz); the other isomer, delta 143.8, 126.0, 117.4, (61.59, 61.51, J(P-C) =6 Hz), 50.2, (27.28, 25.41, J(P-C) 140.25 Hz) and (15.85, 15.79, J(P-C) =4.5 Hz).

Other benzotriazoles of the formula (I) can be prepared by varying the alkyl substituent on the trialkyl phosphite starting material or by varying the substituent on the benzotriazole.

EXAMPLE 2

This example demonstrates the load carry (extreme pressure) capacity of the benzotriazoles of the invention using the initial seizure load (ISL) test. The initial seizure load is the load at which there is a rapid increase in wear as measured by the wear scar diameter determined by a Four Ball Test. The Four Ball tester used in this work is described in "Standard Handbook of Lubrication Engineering" Section 27, page 4, J.J. O'Connor, Editor in Chief, McGraw-Hill Book Company (1968). In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 nm. Prior to the tests, the test cup, steel balls, and all holders were washed with 1,1,1 trichloroethane. The steel balls subsequently were washed with a laboratory detergent to remove any solvent residue, rinsed with water, and dried under nitrogen. The tests lubricant covers the stationary three balls.

The seizure load tests are performed at room temperature at 1500 RPM for a one minute duration at a given load. After each test, the balls are washed and the wear scar diameter (WSD) on the lower balls measured using an optical microscope. The load at which the wear scar equals or exceeds one millimeter is the initial seizure load (ISL).

To illustrate the effects of stress activation on lubricant compositions according to this invention, lubricant compositions were subjected to the conditions of an oxidation, corrosion and stability (OCS) test. Test conditions are 204° C. for 72 hours in the presence of oxygen. Comparisons are made on test oils before and after being subjected to OCS conditions. Compounds I and II are benzotriazoles of the formula (I) wherein $R=R^1=C_8H_{17}$ and $R=R^1=C_2H_5$, respectively. The balls used in the Four Ball Test were in contact with the formulation containing (I) so the load active fragments released by the stress of the OCS test could be deposited on the surfaces of the metal balls. The balls were then subjected to the Four Ball Test conditions in the spent formulation recovered after the test. The oils were blended at 0.1 wt % additive I or II in pentaerythritol ester as base oil with an additive package containing 2.0 wt % metal passwater, 2.25 wt % antioxidant, 0.10 wt % corrosion inhibitor and 0.04 wt % hydrolytic stabilizer. The results are shown in Table 1.

TABLE 1

| | Before OCS* | | After OCS | |
|---|---|---|---|---|
| | I | II | I | II |
| ISL. kg | 72.5 | 72.5 | 102.5 | 97.5 |

*base oil alone gives an ISL value of 72.5 kg

These results demonstrate the significant improvement in ISL for the benzotriazoles of this invention upon subjection to the high load (stress) conditions of the OCS test.

EXAMPLE 3

This example compares a commercially available amine phosphate additive against compounds I and II from Example 2 under conditions described in Example 2, for elastomer seal stability, competitor lube compatibility and self compatibility pursuant to the specifications of Mil-L-23699D.

In Mil-L-23699, elastomer seal compatibility measures how the formulation swells and changes the tensile strength and flexibility of elastomers. Competitor oil and self compatibility measures how much insoluble sediment the test formulation generates when mixed with a competitor oil or by itself upon standing for a period of time at a designated temperature. Competitor oil compatibility is important because Mil-L-23699 requires all new oils to be compatible with commercial oils that have 23699 approval and are on the Qualified Products List (QPL).

The testing procedure requires the use of silicone elastomers and is described as follows. Silicone elastomer compatibility test is conducted by measuring the volume and tensile strength of a silicone elastomer specimen before and after it is contacted with a test formulation containing the desired load additive. The percent swell and percent change in tensile strength (%CTS) are calculated from these measurements and reported. The silicone elastomer specimen is immersed in the test formulation for 96 hours at 121° C. The competitor oil compatibility test is conducted by mixing 200 ml of competitor oil with 200 ml of a formulation containing the load additive to be tested. The mixture is heated at 105° C. for 168 hours, cooled and filtered through a 1.2 micron glass fitted suction funnel. Self compatibility is measured by heating a 400 ml test formulation containing the load additive to be tested using the procedure of the competitor oil compatibility test. The results are shown in Table 2.

TABLE 2

| | Before OCS | | After OCS | | Commercially Available Amine Phosphate | | Mil-L-23699D Specification |
|---|---|---|---|---|---|---|---|
| | I[a] | II[a] | I | II | | III[c] | |
| Silicone Elastomer Compatibility % Swell | 10.20 | 10.12 | 12.2 | 12.5 | 4.31 | 1.80 | 5-25 |
| % Change Tensile Strength | −19.45 | −19.95 | −23.6 | −28.0 | −46.25 | −55.75 | 0 to −30 |
| Competitor Oil Compatibility[d] | 0.62 | 0.64 | 1.30 | 0.89 | 2.82 | — | ≦2 |
| Self Compatibility | 0.58 | 0.67 | 0.98 | 1.80 | 2.58 | — | ≦2 |

[a]0.1 wt % in test oil formulation
[b]0.03 wt % in test oil formulation
[c]compound III from Example 4, 0.1 wt %
[d]commercially available competitor oil The results in Table 2 show that Compounds I and II meet the requirements of Mil-L-2369D both before and after being subjected to OCS conditions.

EXAMPLE 4

This example compares the load carrying capacity of the following sequence of compounds:

II

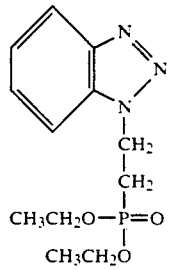

III

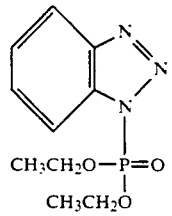

These compounds II-III were blended at 0.1 wt % in base oil and tested in the 4-ball ISL using the procedure given in Example 2. The data given in Table 3 represents ISL values before being subjected to OCS conditions.

TABLE 3

| Compound | ISL, Kg | Silicone Elastomer Compatibility % Swell | % CTS[a] |
|---|---|---|---|
| base oil | 72.5 | 9.83 | −14.03 |
| II | 72.5 | 10.20 | −19.45 |
| III | 82.5 | 1.89 | −55.75 |

[a]Change tensile strength

Table 3 shows that compound II according to the invention is not load-carrying active under non-load conditions whereas compound II exhibits load-carrying activity under non-load conditions. These differences are believed to be due to the manner of bonding of the phosphorus moiety to the benzotriazole ring system. When the phosphorus moiety is bonded directly to the benzotriazole ring system, there is load-carrying activity under non-load conditions. When there is a -$CH_2$- group between the benzotriazole ring system and the phosphours moiety, there is no load-carrying activity over the base oil itself and load-carrying activity is present only after compound II is subjected to stress activation (load conditions) as shown in Example 2. This has the advantages of not subjecting seals and other sensitive components to the load-carrying additive except under stress activation. The load active phosphorus moeity is generated in low concentration as needed and reacts directly with metal surfaces to provide load so there is less present (low concentration) at any given time to cause elastomer problems.

What is claimed is:

1. A lubricant composition which comprises:
(a) a major amount of a lubricating oil basestock, and
(b) a minor amount of a benzotriazole of the formula (I)

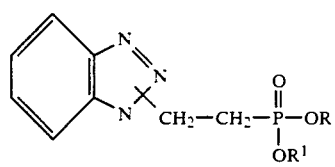

Where R and $R^1$ are independently hydrocarbyl groups having from 1 to 30 carbon atoms.

2. The composition of claim 1 wherein R and $R^1$ are the same.

3. The composition of claim 2 wherein R and $R^1$ are $C_1$ to $C_8$ alkyl.

4. The composition of claim 1 wherein the amount of benzotriazole is from about 0.01 to about 5 wt %, based on lubricant composition.

5. A method for improving the load-carrying capacity of a lubricant composition under load conditions which comprises adding to a major amount of a lubricant basestock a minor amount of a benzotriazole of the formula (I)

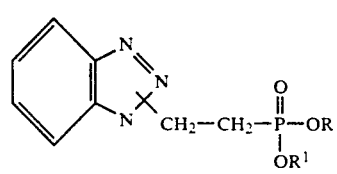

where R and $R^1$ are independently hydrocarbyl groups having from 1 to 30 carbon atoms, and subjecting the lubricant composition to load conditions wherein the benzotriazole becomes load-carrying activated under load conditions.

6. The method of claim 5 wherein R and $R^1$ are the same.

7. The method f claim 6 wherein R and $R^1$ are $C_1$ to $C_8$ alkyl.

8. The method of claim 5 wherein the amount of benzotriazole is from about 0.01 to about 5 wt %, based on lubricant composition.

* * * * *